United States Patent [19]

Alkjaer

[11] Patent Number: 4,685,256

[45] Date of Patent: Aug. 11, 1987

[54] CONNECTION BETWEEN THE LOWER EDGE OF A SKYLIGHT AND THE ADJACENT ROOF COVERING

[75] Inventor: Peter Alkjaer, Glostrup, Denmark

[73] Assignee: V. Kann Rasmussen Industri A/S, Soborg, Denmark

[21] Appl. No.: 838,827

[22] Filed: Mar. 12, 1986

[30] Foreign Application Priority Data

Mar. 26, 1985 [DK] Denmark ..... 1360/85

[51] Int. Cl.[4] ..... E04D 1/36

[52] U.S. Cl. ..... 52/58; 52/60

[58] Field of Search ..... 52/200, 58, 60

[56] References Cited

U.S. PATENT DOCUMENTS 4,154,028 5/1979 Spaulding ..... 52/60
4,573,291 3/1986 Hofmann .

FOREIGN PATENT DOCUMENTS 2361275 6/1974 Fed. Rep. of Germany ..... 52/200
2142722 7/1978 Fed. Rep. of Germany .
2929604 1/1981 Fed. Rep. of Germany .
2946514 5/1981 Fed. Rep. of Germany .
160811 10/1957 Sweden .
7613102-8 1/1979 Sweden .
1429022 3/1976 United Kingdom .

OTHER PUBLICATIONS

Lead Flashings, Weatherings and Roofings, Lead Development Assoc, 1958 p. 29.

*Primary Examiner*—William F. Pate, III
*Assistant Examiner*—Creighton Smith
*Attorney, Agent, or Firm*—Lane and Aitken

[57] ABSTRACT

A skirt (7) of finely corrugated sheet of lead is at its top edge assembled in a folded joint with the lower edge of a covering rail (4) mounted on the lower frame portion (3) of a skylight. A plastic and preferably adhesive material strip (8) is incorporated in the joint and is by the pressing together of the joint made to completely fill the corrugations of the skirt edge portion incorporated in the joint to eliminate flatpressing of the corrugations.

1 Claim, 2 Drawing Figures

CONNECTION BETWEEN THE LOWER EDGE OF A SKYLIGHT AND THE ADJACENT ROOF COVERING

Figures 1, 2:
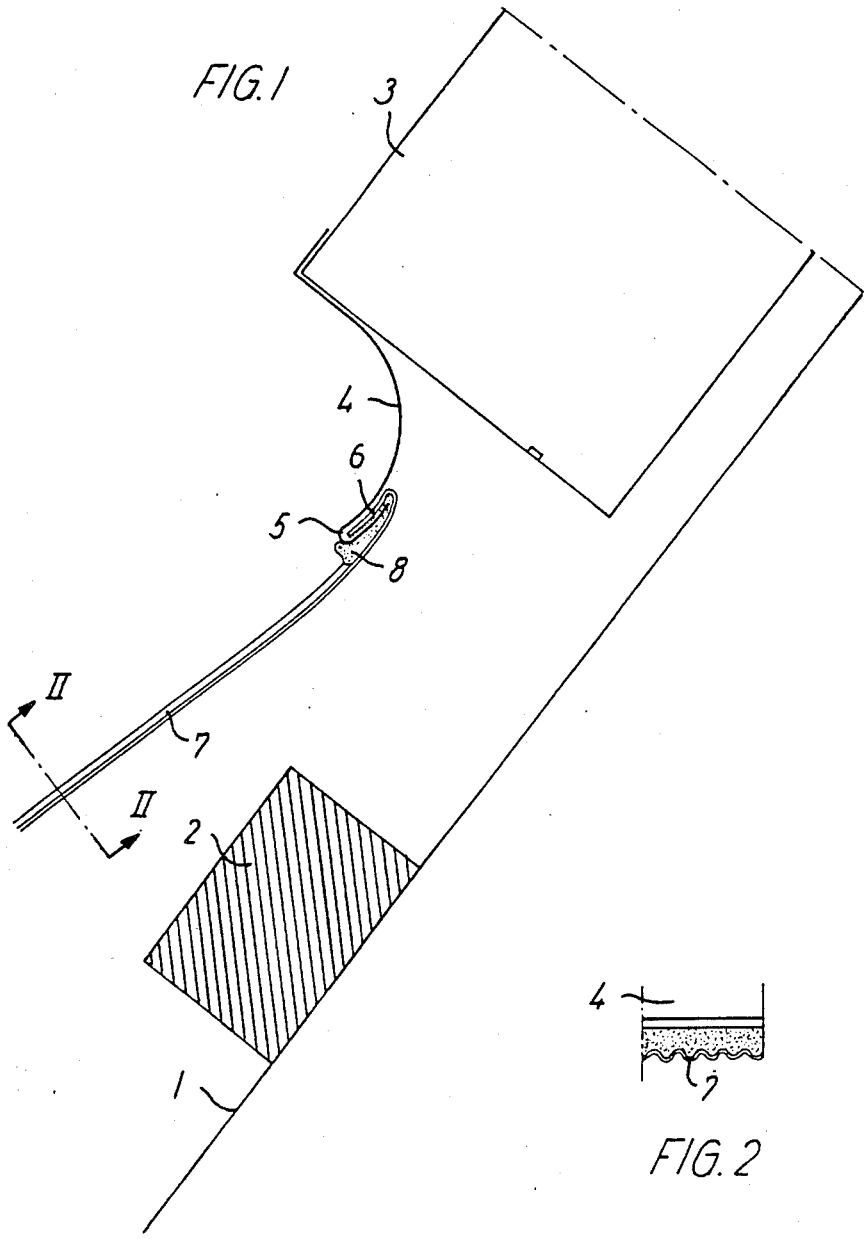

Skylights are frequently delivered with a so-called covering frame consisting for instance of aluminium sheet and comprising a flange lying in a plane parallel to the plane of the window and extending along the top edge and the lateral edges of the window, said flange after installation of the window extending beneath the roof covering. Where this covering is flat and for instance consists of roofing felt or slates, the covering frame may at its lower edge comprise a similar flange adapted to overlie the external surface of the roof covering for some distance and to fit tightly thereto, but in case of non-flat roof coverings, e.g. made from tiles or corrugated sheet, such an arrangement is not practicable, because it is impossible or at any rate very difficult to adapt the plane flange to the shape of the external surface of the roof covering. In this case the slit or the gap between the covering frame and the roof covering is usually covered by an easily deformable piece of sheet and for this purpose pleated or corrugated sheet of lead is particularly appropriate, on the one hand because it is extremely weatherproof and on the other hand because in its usual thickness, normally not exceeding 2 mm, it may without any use of tools be shaped to fit the external surface of the roof covering.

Starting from the above mentioned prior art the invention relates to a connection between the lower edge of a skylight and the adjacent roof covering, comprising a covering rail secured to the lower frame portion of the window, the lower edge portion of said rail being assembled in a folded joint with the upper edge of a skirt made from finely corrugated sheet of lead whose corrugations extend substantially parallel to the lateral edges of the window.

The pleating or the corrugation of the sheet of lead considerabley stiffens the lead against bending transversely of the waves but, nevertheless, it may occur that the skirt, particularly during the installation phase, i.e. prior to its being tightly fitted to the roof covering, may be flown into a flapping or tilting movement due to wind. This is due to the fact that the enhanced bending stiffness of the finely corrugated sheet of lead cannot be maintained in the joint area as the plate in this area is folded transversely of the waves and to a considerable degree is flattened by the final pressing together of the joint.

The invention aims at eliminating the occurrence of said wind-provoked movement which may cause a hampering rattling and also a weakening of the sheet of lead as a consequence of its structural changes.

To fulfill said purpose the folded joint, in the arrangement according to the invention, incorporates a plastic material strip which prior to the forming of the joint is located at the top edge portion of the skirt and which by the pressing together of the joint is made to completely fill the corrugation of the edge portion incorporated in the joint and further to form an adhesive bond between the skirt and the outside of the joint portion of the covering rail.

The plastic material strip contributes to maintaining the wave corrugation in the joint portion of the skirt both during the transverse folding thereof, as referred to above, and during the final pressing together of the joint, thereby also maintaining the stiffness of the skirt against hampering or damaging flapping movements as long as the skirt has not in any other way been secured to the roof covering, and such movements are further opposed by the adhesive bond, so that the weakest point of the lead plate is all in all considerably relieved, viz. at the bending line of the fixing portion.

The invention is illustrated by an embodiment on the drawing, in which

FIG. 1 is a section showing a skylight with the connection according to the invention, the section being perpendicular to a batten of the roof structure, and FIG. 2 is part of a section along the line II—II in FIG. 1.

In the drawing 1 designates the top edge of a rafter with horizontal battens 2 of which only one is shown and which are adapted to support the roof covering not yet laid, e.g. tiles or corrugated sheets.

In the roof structure a window 3 is installed of which only the lower portion of the frame is shown. A covering rail 4 arched in cross-section is secured to the lower frame portion, said rail being folded at its lower edge to form an internal groove 5. The outwardly and downwardly folded edge 6 of a skirt 7 of finely corrugated sheet of lead extends into said groove, see also FIG. 2, the wave crests extending in the direction of the roof inclination.

Before folding the upper edge 6 of the skirt a tape or a strip 8 of a plastic and adhesive material, for instance bitumen, has been applied thereto, having a width corresponding to about the double width of the edge 6 engaging the groove 5, so that said material by the final pressing together of the joint is pressed down into the corrugations of the skirt on either side of the folding edge, i.e. on both the inner and outer surfaces of the upwardly directed edge forming one of the walls of the groove 5. At the same time the material provides a stabilizing adhesive bond between said edge and the top edge portion of the skirt.

I claim:

1. A connection between an edge of a skylight window and an adjacent roof covering, the window including a frame having a bottom portion and lateral edges comprising:

a covering rail secured to the bottom portion of the frame, said covering rail having a lower edge portion;

a skirt comprising a finely corrugated sheet of lead and having a upper edge, wherein the corrugations extend substantially parallel to the lateral edges of the frame, and said lower edge portion of said covering rail defines a folded joint with the upper edge of the skirt, said lower edge portion being immovable relative to said upper edge of the skirt; and a strip of plastic material positioned at the upper edge of said skirt, said strip completely filling said corrugations of said skirt and defining an adhesive bond between said skirt and said lower edge portion of said covering rail.

* * * * *

UNITED STATES PATENT AND TRADEMARK OFFICE

CERTIFICATE OF CORRECTION

PATENT NO. : 4,685,256

DATED : August 11, 1987

INVENTOR(S) : Peter Alkjaer

It is certified that error appears in the above-identified patent and that said Letters Patent is hereby corrected as shown below:

Column 1, line 45, "flown" has been changed to --blown--;

line 50, before "joint", --skirt and covering rail at the-- has been inserted; and line 61, "corrugation" has been changed to --corrugations--.

Signed and Sealed this

First Day of December, 1987

*Attest:*

*Attesting Officer*

DONALD J. QUIGG

*Commissioner of Patents and Trademarks*